US011322812B2

(12) United States Patent
Pröckl et al.

(10) Patent No.: US 11,322,812 B2
(45) Date of Patent: May 3, 2022

(54) ROTARY JOINT

(71) Applicant: Spinner GmbH, Feldkirchen-Westerham (DE)

(72) Inventors: Thomas Pröckl, Bad Aibling (DE); Friedrich Jakob, Munich (DE); Bernhard Rimsl, Feldkirchen-Westerham (DE)

(73) Assignee: SPINNER GMBH, Feldkirchen-Westerham (DE)

( * ) Notice: Subject to any disclaimer, the term of this patent is extended or adjusted under 35 U.S.C. 154(b) by 0 days.

(21) Appl. No.: 17/423,403

(22) PCT Filed: Jan. 14, 2020

(86) PCT No.: PCT/EP2020/050823
§ 371 (c)(1),
(2) Date: Jul. 15, 2021

(87) PCT Pub. No.: WO2020/148287
PCT Pub. Date: Jul. 23, 2020

(65) Prior Publication Data

US 2022/0077551 A1 Mar. 10, 2022

(30) Foreign Application Priority Data

Jan. 16, 2019 (DE) ..... 10 2019 200 485.7

(51) Int. Cl.
*H01P 1/06* (2006.01)

(52) U.S. Cl.
CPC ..... *H01P 1/066* (2013.01)

(58) Field of Classification Search
CPC ..... H01P 1/06; H01P 1/066
See application file for complete search history.

(56) References Cited

U.S. PATENT DOCUMENTS 3,426,309 A * 2/1969 Goodman, Jr. ..... H01P 1/067 439/5
5,781,087 A 7/1998 Milroy et al.
(Continued)

FOREIGN PATENT DOCUMENTS

DE 19612109 C1 11/1997
DE 202006006813 U1 7/2006
(Continued)

OTHER PUBLICATIONS

International Search Report for PCT/EP2020/050823, dated Apr. 14, 2020; English translation submitted herewith (6 pgs.).

*Primary Examiner* — Dean O Takaoka
(74) *Attorney, Agent, or Firm* — Fitch, Even, Tabin & Flannery LLP

(57) ABSTRACT

The invention relates to a rotary joint which comprises two components mounted for rotation relative to one another about an axis of rotation, and each comprising electrically conductive material and jointly enclosing at least one intermediate gap, which is in the form of a capacitive gap for the purpose of transmitting electrical signals and/or energy. The two components are mounted by means of at least one plain bearing such that they are axially fixed longitudinally relative to the axis of rotation and can be rotated relative to one another about the axis of rotation. The plain bearing has at least one plain bearing gap, at least some regions of which correspond to the capacitive gap. The invention is characterized in that the surface of at least one of the two components has, at least in the region of the capacitive gap, the electrically conductive material with an electrically insulating layer in the form of a metal oxide layer.

16 Claims, 2 Drawing Sheets

(56) References Cited

U.S. PATENT DOCUMENTS

Figure 1:
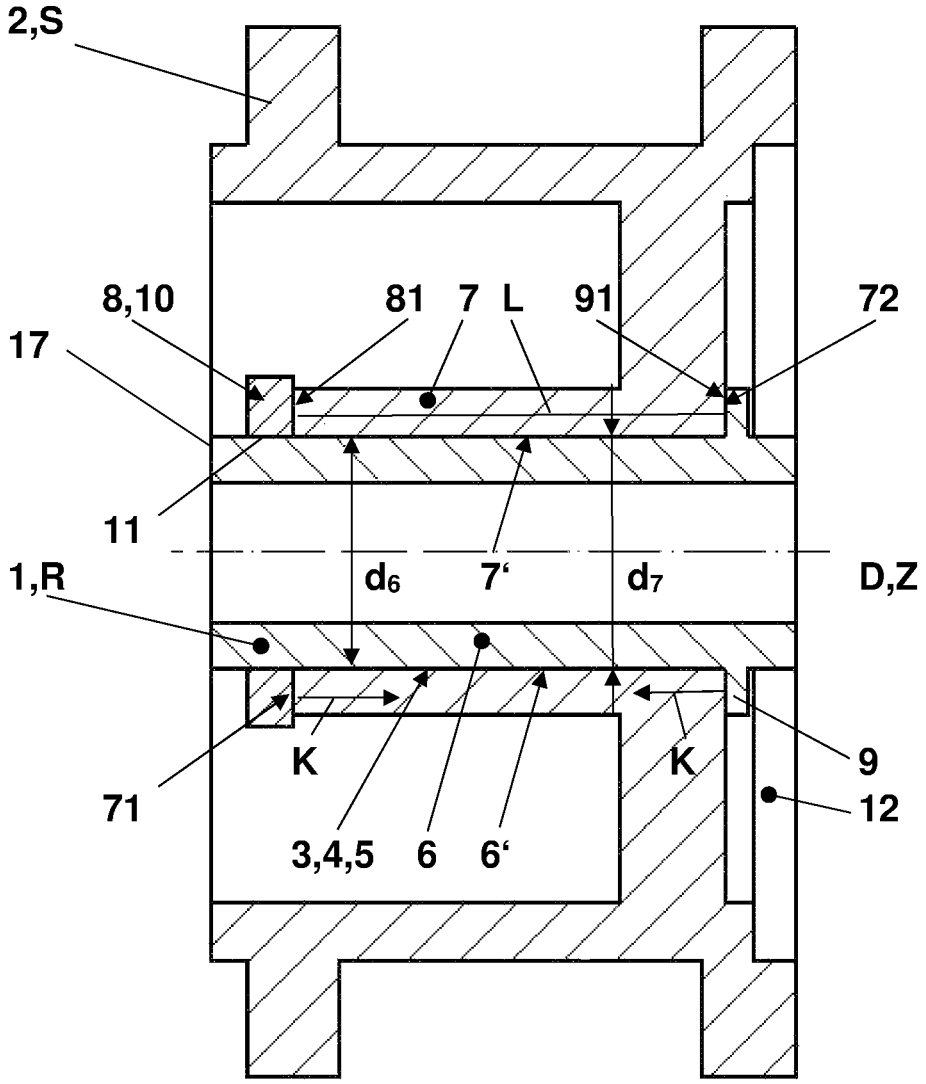

| | | | | |
|---|---|---|---|---|
| 2001/0045877 | A1* | 11/2001 | Christian | H01P 1/066<br>333/261 |
| 2004/0051604 | A1 | 3/2004 | Lohr | |
| 2010/0183254 | A1 | 7/2010 | Jensen et al. | |
| 2019/0293120 | A1 | 9/2019 | Schmitt et al. | |

FOREIGN PATENT DOCUMENTS

| | | | |
|---|---|---|---|
| DE | 102007042382 | B3 | 4/2009 |
| DE | 102016213352 | A1 | 1/2018 |
| EP | 0443536 | A2 | 8/1991 |
| JP | H07-122903 | A | 5/1995 |

* cited by examiner

ROTARY JOINT

CROSS-REFERENCE TO RELATED APPLICATIONS

This application is a U.S. national phase application filed under 35 U.S.C. § 371 of International Application No. PCT/EP2020/050823, filed Jan. 14, 2020, designating the United States, which claims priority from German Patent Application No. 10 2019 200 485.7, filed Jan. 16, 2019, which are hereby incorporated herein by reference in their entirety.

TECHNICAL AREA

The invention relates to a rotary joint which comprises two components mounted for rotation relative to one another about an axis of rotation, and each comprising electrically conductive material and jointly enclosing at least one intermediate gap, which is in the form of a capacitive gap for the purpose of transmitting electrical signals and/or energy, wherein the two components are mounted by means of at least one plain bearing such that they are axially fixed longitudinally relative to the axis of rotation and can be rotated relative to one another about the axis of rotation, and the plain bearing has at least one plain bearing gap, at least some regions of which correspond to the capacitive gap.

RELATED ART

A species-related rotary joint is described in patent DE 26 53 209 C3. The known coaxial rotary joint is characterized by conductive sections on the rotor and the stator side, which are folded radially relative to the axis of rotation and delimit each of the resonance cavities contactlessly from one another. The folded conductive sections each form a plurality of conductive sections positioned separately from each other radially and constructed in the form of capacitor plates, and each of which encloses a capacitive gap which is designed to be suitable for transmitting electrical energy and signals. To enable rotary mounting, rotor and stator are mounted in axially fixed manner relative to and rotatable about the axis of rotation by means of a rolling bearing in the form of two ball bearings.

The creation of rotary joints of such kind is most often labour-intensive and expensive, since dimensions of the capacitive gap widths are only very small and place high demands on the roller bearings mounted in the rotary joint with reduced bearing clearance. To these are added considerable operating requirements in terms of mechanical robustness, climatological durability and long service life. Moreover, the function of the rotary joints should not depend on their spatial Installation position.

Patent EP 443 536 A2 describes a contactless coaxial rotary joint with a cylindrical rotor unit which rotates about an axis of rotation, wherein a multiplicity of ring electrodes in the form or strips are arranged along the length of the cylinder barrel surface, separated axially from each other, and cooperate with ring electrodes mounted on the stator side to enclose single capacitive gaps. The strip-like ring electrodes arranged on the on the stator side are mounted on the inner sleeve wall of a sleeve that surrounds the cylindrical rotor unit radially. The mounting of the rotor, which is axially fixed yet rotatable relative to the stator may be realised with a rolling bearing or a magnetic bearing.

Patent US 2004/0051604 A1 discloses a rotary bearing with a capacitive gap having a gap cavity filled with a dielectric that is gaseous or liquid in order to avoid an electrical short circuit.

SUMMARY OF THE INVENTION

The object underlying the invention is that of further developing a rotary joint with two components mounted for rotation about an axis of rotation relative to one another and each comprising electrically conductive material and jointly enclosing at least one intermediate gap, which is in the form of a capacitive gap for purposes of transmitting electrical signals and/or energy, wherein both components are mounted by means of at least one plain bearing such that they are axially fixed longitudinally relative to the axis of rotation and can be rotated relative to one another about the axis of rotation, and the plain bearing has at least one plain bearing gap at least some regions of which correspond to the capacitive gap, to such effect that the rotary joint should possess improved mechanical robustness, so that its functional reliability should be maintained without limitation even under any conditions of spatial installation positions, and all in a temperature range from −40° C. to +55° C. and with a service life of more than 100 million revolutions. Further, it should also be possible to produce the rotary joint inexpensively and with low manufacturing effort. Finally, the rotary joint should be scalable without limits and in particular especially suitable for use in rotary systems with limited space allowances.

The solution to the object underlying the invention is described in claim 1. Features which advantageously advance the inventive thought constitute the objects of the subordinate claims and are made apparent in the following description, in particular with reference to the illustrated exemplary embodiments.

According to the solution, the rotary joint having the features of the preamble of claim 1 is characterized in that the surface of at least one of the two components has the electrically conductive material with an electrically insulating layer in the form of a metal oxide layer at least in the region of the capacitive gap.

The idea underlying the invention relates to the combination of the functions regarding mounting the rotor on the stator and the capacitive transmission of energy and signals along the capacitive gap in the framework of a plain bearing while simultaneously using at least one abrasion-resistant and robust electrically insulating layer in the form of a metal oxide layer.

The capacitive gap between the rotor and the stator that serves the purpose of ensuring contactless transmission of electrical energy and signals is delimited by at least two electrically conductive material surfaces, which have the function of capacitor electrodes.

The capacitive gap typically has a gap width b for which $0.001\ \text{mm} \leq b \leq 0.02\ \text{mm}$ is true.

At least one of the two oppositely arranged electrically conductive material surfaces is additionally coated with an electrically insulating metal oxide layer. The nature of the metal oxide layer depends primarily on the choice of the electrically conductive base material in each case. The metal oxide layer is formed by passivation or oxidation in the monolithic bond with the electrically conductive material surface and accordingly has good abrasion resistance.

It is also conceivable to provide a silver-graphite or silicon carbide layer directly or indirectly on at least one of the two oppositely arranged, electrically conductive material surfaces in combination with electrically insulating metal oxide layer described previously. Thus, both silver-graphite and silicon carbide are each notable for exceptional material hardness and high abrasion resistance associated therewith, and consequently serve to prolong the service life of the rotary joint.

Depending on the technical purpose and application for which the rotary joint is intended, the intermediate gap enclosed indirectly or directly between the oppositely positioned, electrically conductive material surfaces is filled with gas-phase medium, such as air, or with a low-viscosity lubricant, preferably in the form of a thin, synthetic longlife oil.

In general, electrically conductive materials such as for example aluminium, aluminium bronze, aluminium brass, copper alloy or light metal alloys are very well suited for forming the material surfaces on both sides which delimit the capacitive gap on the side of the stator and the rotor. Particularly when aluminium or an aluminium alloy is used as the electrically conductive material, a hard anodised aluminium layer which is obtained in an anodising or hard anodising process and is therefore notable as a particularly abrasion-resistant aluminium oxide layer, is well suited for forming an electrically insulating layer which is preferably to be provided.

In one possible variant of the rotary joint, the components functioning as rotor and stator are manufactured substantially from an electrically insulating material, preferably a lightweight plastic or a plastic composite material in which electrically conductive structures are implemented, preferably in the form of electrically conductive tracks or layers, or are applied at least in regions to the component surfaces thereof for the purpose of transmitting electrical energy and signals. At least the surfaces of the rotor and the stator facing towards the capacitive gap are coated with an electrically conductive material layer, of which at least one is coated with a metal oxide layer.

In a particularly preferred variant, the components, i.e. the rotor and stator of the rotary joint are each manufactured entirely from one of the electrically conductive materials identified earlier. Accordingly, it is reasonable to manufacture the rotor and the stator from a single part out or a metal body. Besides conventional material-removing manufacturing methods, generative manufacturing processes such as selective laser melting or sintering may also be considered for this purpose.

Preferably at least one of the metallic components of the rotary joint is furnished with a metal oxide layer at least in the region of the capacitive gap. Preferably and not least for manufacturing reasons, the metallic component in question is covered or coated entirely with a metal oxide layer.

Particular when aluminium or an aluminium alloy is used to produce at least one component of the rotary joint, the electrically insulating layer consists of an aluminium oxide layer created as a hard anodised aluminium layer. The hard anodised aluminium layer that is producible by hard anodising offers significant protection from wear and corrosion and has good tribological properties, or very good antifriction properties depending on the structural and material constitution of the component surface arranged opposite in each case. In a preferred variant, at least the component surface arranged opposite the hard anodised aluminium layer is made from aluminium bronze. Of course, it is also conceivable to introduce other abrasion-resistant materials between the substance surfaces arranged opposite one another along the capacitive gap as well, such as silver-graphite, silicon carbide or antifriction coatings.

The plain bearing of the rotary joint constructed according to the solution is advantageously designed in the form of a radial bearing, by means of which the rotor is mounted so as to be axially fixed and rotatable about the axis of rotation relative to the stator. A plain bearing may be constructed in the form of an axial bearing, as it were. Design details of particularly advantageous variants may be discerned from the following figures.

BRIEF DESCRIPTION OF THE INVENTION

Figure 2:
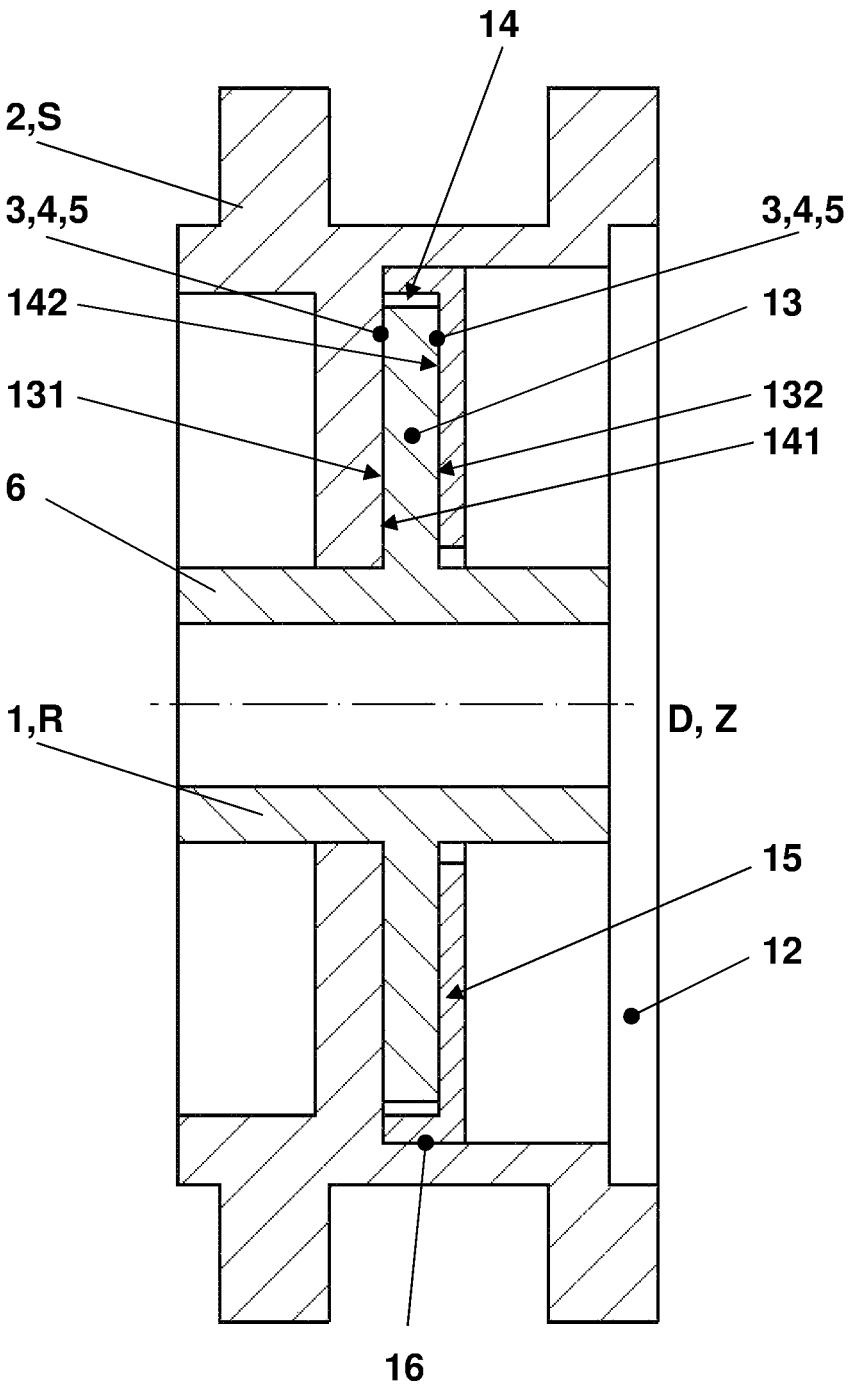

In the following text, the invention will be described for exemplary purposes without limitation of the general inventive thought using embodiments thereof and with reference to the drawing. In the drawing:

FIG. 1 shows a lengthwise cross section through stator and rotor of a rotary joint embodied according to the solution with a plain bearing designed as radial bearing, and FIG. 2 shows a lengthwise cross section through stator and rotor of a rotary joint embodied according to the solution with a plain bearing designed as axial bearing.

WAYS TO IMPLEMENT THE INVENTION, INDUSTRIAL APPLICABILITY

FIG. 1 represents a lengthwise cross section through a rotary joint of preferred construction which includes two components 1, 2 that are each manufactured as a single part, and of which the component 1, designated rotor R, is mounted in such manner as to be axially fixed and rotatable about the axis of rotation D relative to the component 2, designated stator S.

In the case represented, the component 1 or the rotor R is made from aluminium, of which the entire component surface is coated with a hard anodised aluminium layer by an anodising or hard anodising process. In contrast to this, the component 2 or the stator S is manufactured from aluminium bronze and does not have a corresponding electrically insulating surface coating, but one may certainly be provided as an option.

The component 1, which in the following text will be designated rotor R, has a shaft section 6 with a straight cylindrical form, which is manufactured as a hollow shaft, and a shaft surface 6' with a straight cylindrical form, which is coated with a hard anodised aluminium layer, not shown in further detail, as is the rest of the component surface of rotor R.

The shaft axis Z associated with the shaft section 6 of the rotor R is oriented coaxially with the axis of rotation D of the rotary joint. For this purpose, the shaft section 6 is mounted inside a sleeve element 7 on the stator side, wherein the inner sleeve surface 7' radially encloses at least regions of the shaft surface 6' in the circumferential direction of the shaft surface 6', preferably the entire circumference thereof, and axially at least partially, preferably entirely.

The dimensions of the shaft outer diameter $d_6$ of the shaft section 6 and of the sleeve inner diameter $d_7$ of the sleeve element 7 are matched with each other in such manner that enclosed between the hard anodised shaft surface 6' and the inner sleeve surface 7', which is made from aluminium bronze and finished with a honing process, an intermediate gap 3 is created that is oriented radially to the axis of rotation D and has a gap width b, and for which gap $0.001\ \text{mm} \leq b \leq 0.02\ \text{mm}$ is true.

Due to the intermediate gap 3 having predefined suitable dimensions, which is preferably filled with an appropriately selected gas, for example air, or a low-viscosity, oil-containing lubricant, unhindered rotatability of the rotor R inside the sleeve element 7 and thus also relative to the immovably mounted stator S may be assured. An additional retaining mechanism which positions the shaft section 6 fixedly axially with the axis of rotation D relative to the sleeve element 7 on the stator side is implemented for the purpose of axially fixed mounting of the rotor R relative to the stator S along the axis of rotation D. Firstly, the retaining mechanism has two shaft collars 8, 9 which are located along the shaft section 6 with axial separation between them, each collar projecting radially outwardly from the shaft surface 6' and having a radially oriented slide face 81, 91, which slide faces are oriented to face one another. Secondly, the retaining mechanism also provides two sleeve element frontal faces 71, 72 which are located axially separately from one another along the stator-side sleeve element 7 and are oriented axially opposingly to each other in such manner that the slide and frontal faces are in sliding contact with each other in pairs—see respective pairs (81/71) and (72/91)—thereby creating a clamping force K which retains the rotor R in fixed axial position longitudinally with the axis of rotation D relative to the stator S.

The collar 9 is attached integrally to the shaft section 6, whereas the collar 8 attached on the left of the shaft section 6 in FIG. 1 is embodied as a bearing nut 10 that is separable from the shaft section 6, and which may be attached to the shaft section 6 fixedly but separably via a thread 11. In this way, axial mounting of the rotor R and the stator S may be accomplished simply. The rotor-side shaft section 6 may be inserted in the interior of the sleeve element 7 axially via the mounting opening 12, wherein at least a portion of the shaft section 6 protrudes beyond the axial length L of the sleeve element 7 in the direction of insertion. The external thread 11 with which the bearing nut 10 engages is conformed on the portion of the shaft section which protrudes from the sleeve element 7, so that the rotor R is mounted so as to be on the one hand rotatable about the axis of rotation D and on the other hand axially fixed with respect thereto.

The novel rotary joint is thus characterized by a pure, that is to say solely plain bearing between stator S and rotor R, which in the embodiment shown is realised as a radial bearing, and a plain bearing gap 5, and also has an axial plain bearing length L, which at the same time matches the length of the capacitive gap 4 which serves to transmit electrical energy and signals between the rotor R and the stator S.

Possible dimensional variations in the dimensioning of the plain bearing gap 5 attributable to the manufacturing process, which gap corresponds to the previously described capacitive gap 4, can be eliminated within a production batch by final machining of the inner sleeve surface 7' of the sleeve element 7 in a honing process.

With rotary joint presented in the preceding text, it was possible to prove experimentally that when a one-time lubrication of the plain bearing gap 5 was carried out with a very thin, synthetic, longlife oil no significant material abrasion occurred on the plain bearing of the rotary joint after more than 22 million rotations. This achievement is the more surprising since the shaft section 6 was subjected to an eccentric shearing force of about 44 Newton throughout the experiment.

FIG. 2 shows a longitudinal cross section through an alternative design of a rotary joint according to the solution, in which the plain bearing with the capacitive gap is constructed as an axial plain bearing. In this case, the rotor R which is embodied as a hollow shaft has a shaft section 6 which is constructed in the form of a hollow cylinder, of which the associated cylinder axis Z corresponds to the axis of rotation D about which the rotor R is mounted for rotation relative to the stator S. The shaft section 6 of the rotor R constructed as a hollow cylinder has at least one collar 13 in the form of a hollow disc which protrudes radially beyond the shaft section 6, each of which has two collar surfaces 131 and 132, which face in axially opposite directions and have face normals oriented parallel to the axis of rotation D. The rotor-side collar 13 which is preferably joined integrally with the shaft section 6 protrudes on the stator side into a groove-like recess 14 with a contour shaped to correspond to the collar 13, which recess has stator faces 141, 142 which are positioned axially directly opposite the respective collar surfaces 131, 132. In the same way as for the rotary joint illustrated in FIG. 1, the collar surfaces and the stator faces 131, 141 and 132, 142 each cooperate as a pair with the axially directly opposing counterpart to delimit an intermediate gap 3, which serves the purposes of both transmitting electrical energy and/or signals as a capacitive gap 4 and as plain bearing gap 5 for the axial plain bearing. Unlike FIG. 1, each intermediate gap 3 is oriented radially with respect to the axis of rotation D.

Due to a technically insignificant material abrasion on the rotor and stator side, the rotor surface of the rotor R, which is preferably constructed as a single part from aluminium is preferably coated over the entire circumference thereof with an electrically insulating layer in the form of a hard anodised aluminium layer.

The stator S, which is preferably made from aluminium bronze, may optional be covered with a correspondingly metal oxide, electrically insulating layer.

For reasons associated with the assembly, the stator S is constructed in at least two parts, i.e., the stator face 142 which cooperates with stator face 141 to hold the rotor R axially fixedly and rotatably about the axis of rotation D forms the surface of a separate annular lid element 15, which is joined axially about the rotor and is joined fixedly or firmly but separably with the rest of the stator S in the configuration illustrated in FIG. 2 after the rotor R is inserted in the stator S through the mounting opening 12. For example, an external thread 16 created on the edge of the annular lid element 15, and which can be brought into engagement with a correspondingly contoured matching thread on the stator side is suitable for this. Alternatively, it is equally conceivable to attach the annular lid element 15 to the stator S by welding, adhesive bonding or another permanently fixed joint connection with equivalent effect.

Particularly in the case of very small gap widths b of the capacitive gap 4, very high capacitances and the associated low reactances or capacitive reactances may be realised between rotor R and stator S. The rotary joint concept according to the solution enables an inexpensive yet robust, durable and reliable creation of rotary joints, in particular with the capacitive gap widths b of the smallest dimensions through deliberate synergistic use of plain bearings and capacitive transmission of electrical energy and signals in s single unit.

Of course, it is also possible to implement the plain bearing described in the preceding text between rotor and stator without the capacitive coupling function necessary for transmitting electrical energy and signals, simply as a mechanical rotary joint. A mechanical rotary joint of such kind is characterized by its very small installation space and high invulnerability to wear.

LIST OF REFERENCE SIGNS

1, 2 Components of the rotary joint
3 Intermediate gap

4 Capacitive gap
5 Plain bearing gap
6 Shaft section
6' Shaft surface
7 Sleeve element
7' Inner sleeve surface
8 Collar
81 Slide face
9 Collar
91 Slide face
10 Bearing nut
11 Thread
12 Mounting opening
13 Collar
131, 132 Collar surface
14 Recess
141, 142 Stator face
15 Annular lid element
16 External thread
D Axis of rotation
R Rotor
S Stator
Z Cylinder axis
d6 Shaft section outer diameter
d7 Sleeve element inner diameter
L Plain bearing gap length

The invention claimed is:

1. A rotary joint with two components mounted for rotation relative to one another about an axis of rotation (D), each comprising electrically conductive material and jointly enclosing at least one intermediate gap, which is in the form of a capacitive gap for the purpose of transmitting electrical signals and/or energy, wherein the two components are mounted by means of at least one plain bearing such that they are axially fixed longitudinally relative to the axis of rotation (D) and can be rotated relative to one another about the axis of rotation (D), and the plain bearing has at least one plain bearing gap, at least some regions of which correspond to the capacitive gap, wherein the surface of at least one of the two components has, at least in the region of the capacitive gap, the electrically conductive material with an electrically insulating layer in the form of a metal oxide layer.

2. The rotary joint according to claim 1, wherein the two components are furnished with the electrically conductive material at least in a region facing the capacitive gap.

3. The rotary joint according to claim 1, wherein the electrically conductive material is selected from the following metals or metal compounds: aluminium, aluminium bronze, aluminium brass, copper alloys, light metal alloys.

4. The rotary joint according to claim 2, wherein the electrically insulating layer has a hard anodised aluminium layer.

5. The rotary joint according to claim 1, wherein at least one component has a layer containing silver-graphite or silicon carbide at least in the region of the capacitive gap.

6. The rotary joint according to claim 1, wherein the capacitive gap has a gap width b for which 0.001 mm≤b≤0.02 mm is true.

7. The rotary joint according to claim 1, wherein the plain bearing is embodied as a radial bearing with at least one plain bearing gap extending axially between the two components, which corresponds to the capacitive gap.

8. The rotary joint according to claim 1, wherein one of the two components, designated subsequently as rotor (R), is arranged so as to be axially fixed and rotatable about the axis of rotation (D) relative to the other component, designated subsequently as stator (S), that the rotor (R) has a shaft section in the form of a straight cylinder, whose associated shaft axis (Z) is oriented coaxially with the axis of rotation (D) and of which regions of an associated shaft surface are enclosed radially at least in the circumferential direction and axially at least partially by a sleeve element arranged on a stator side, and that the rotor-side shaft surface and an inner sleeve surface of the stator-side sleeve element enclose the capacitive gap.

9. The rotary joint according to claim 8, wherein the plain bearing comprises a retaining mechanism which positions the shaft section fixedly axially longitudinally and rotatably about to the axis of rotation (D) relative to the sleeve element on the stator side, and the capacitive gap.

10. The rotary joint according to claim 8, wherein the retaining mechanism comprises two shaft collars which are located along the shaft section with axial separation between them, each collar protruding radially outwardly from the shaft surface and having a radially oriented slide faces which are oriented to face one another axially, and two frontal faces which are located axially separately from one another along the stator-side sleeve element and are oriented axially opposingly to each other, wherein the slide faces and frontal faces are in sliding contact with each other in pairs, thereby creating a clamping force which retains the rotor (R) in fixed axial position longitudinally and rotatably about the axis of rotation (D) relative to the stator (S).

11. The rotary joint according to claim 10, wherein at least one of the two collars is embodied as a bearing nut, which is fixedly but separably attached to the rotor-side shaft section via a thread.

12. The rotary joint according to claim 1, characterized in that the plain bearing is constructed in the form of an axial bearing with at least one plain bearing gap extending radially between the two components, which corresponds to the capacitive gap.

13. The rotary joint according to claim 1, characterized in that the components are each manufactured as a single part from electrically conductive material.

14. The rotary joint according to claim 9, characterized in that the rotor (R) is manufactured from aluminium and is entirely coated with an aluminium oxide layer as hard anodised aluminium layer, and that the stator (S) is made from aluminium bronze.

15. The rotary joint according to claim 7, wherein the plain bearing gap is filled with a gaseous medium and/or an oil-containing lubricant.

16. The rotary joint according to claim 1, wherein a dielectrically insulating layer is connected monolithically to the electrically conductive material.

* * * * *